US011727856B2

(12) United States Patent
Kwak

(10) Patent No.: US 11,727,856 B2
(45) Date of Patent: Aug. 15, 2023

(54) LIGHT EMITTING DISPLAY APPARATUS

(71) Applicant: LG Display Co., Ltd., Seoul (KR)

(72) Inventor: Bongchoon Kwak, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/899,247

(22) Filed: Aug. 30, 2022

(65) Prior Publication Data

US 2023/0206818 A1 Jun. 29, 2023

(30) Foreign Application Priority Data

Dec. 23, 2021 (KR) ..... 10-2021-0186123

(51) Int. Cl.
*G09G 3/32* (2016.01)
*G09G 3/20* (2006.01)
*G09G 3/34* (2006.01)

(52) U.S. Cl.
CPC ..... *G09G 3/2096* (2013.01); *G09G 3/3406* (2013.01); *G09G 2300/0426* (2013.01); *G09G 2300/0842* (2013.01); *G09G 2330/021* (2013.01); *G09G 2330/08* (2013.01)

(58) Field of Classification Search
CPC ..... H01L 21/66; H01L 23/525; H01L 23/532; H01L 29/08; H01L 27/12; H01L 27/15; H01L 27/32; H01L 51/52; H01L 51/56; G09G 3/00; G09G 3/20; G09G 3/30; G09G 3/32; G09G 3/36; G09G 3/2096; G09G 3/3506; G09G 3/3266; G09G 3/3291; G09G 3/3208; G09G 3/3233; G09G 3/3258; G09G 3/3275; G09G 5/00; G09G 5/02; G09G 5/10; G09G 5/18; G09G 2300/0426; G09G 2300/0842; G09G 2330/021; G09G 2330/08; G11C 17/16

See application file for complete search history.

(56) References Cited

U.S. PATENT DOCUMENTS

| | | | | |
|---|---|---|---|---|
| 10,872,559 | B2 | 12/2020 | Lee | |
| 2012/0162165 | A1* | 6/2012 | Lee | G09G 3/006 345/206 |
| 2015/0103103 | A1* | 4/2015 | Kim | G09G 3/3233 345/690 |
| 2016/0005383 | A1 | 1/2016 | Lee et al. | |
| 2019/0012965 | A1* | 1/2019 | Fu | H01L 27/3276 |
| 2021/0020729 | A1* | 1/2021 | Kitakado | H01L 51/50 |
| 2022/0383799 | A1* | 12/2022 | Liu | G09G 3/32 |

FOREIGN PATENT DOCUMENTS

| | | |
|---|---|---|
| KR | 10-2016-0007875 A | 1/2016 |
| KR | 10-2020-0046434 A | 5/2020 |

* cited by examiner

*Primary Examiner* — Chanh D Nguyen
*Assistant Examiner* — Nguyen H Truong
(74) *Attorney, Agent, or Firm* — Birch, Stewart, Kolasch & Birch, LLP

(57) ABSTRACT

A light emitting display apparatus can include a first pixel and a second pixel. The first pixel can include a first light emitting device and a first pixel driving circuit configured to drive the first light emitting device. The second pixel can include a second light emitting device and a second pixel driving circuit configured to drive the second light emitting device. The light emitting display apparatus can further include a repair transistor connected between the first light emitting device and the second light emitting device, and a repair control transistor connected to a gate of the repair transistor.

14 Claims, 10 Drawing Sheets

LIGHT EMITTING DISPLAY APPARATUS

CROSS-REFERENCE TO RELATED APPLICATIONS

This application claims the priority benefit of the Korean Patent Application No. 10-2021-0186123 filed on Dec. 23, 2021 in the Republic of Korea, the entire contents of which are hereby expressly incorporated by reference into the present application.

BACKGROUND

Field of the Invention

The present disclosure relates to a light emitting display apparatus.

Discussion of the Related Art

A light emitting display panel includes pixels including a light emitting device. The light emitting display panel can be manufactured by using a base substrate such as glass or a film, or can be manufactured by using a silicon substrate.

In performing a process of manufacturing a light emitting display panel, a defective pixel can occur due to various reasons.

A defective pixel occurring in a light emitting display panel including a base substrate can be physically repaired through a repair process using a laser and can be normally driven through a welding process. However, complicated processes such as the repair process and the welding process are performed so that the defective pixel is normally driven.

A defective pixel occurring in a light emitting display panel including a silicon substrate can be darkened through the repair process using a laser, or may not be normally driven by the welding process.

SUMMARY OF THE DISCLOSURE

Accordingly, the present disclosure is directed to providing a light emitting display apparatus that substantially obviates one or more problems due to limitations and disadvantages of the related art.

An aspect of the present disclosure is directed to providing a light emitting display apparatus which can normally drive a defective pixel by using a repair transistor included in a pixel driving circuit.

Additional advantages and features of the disclosure will be set forth in part in the description which follows and in part will become apparent to those having ordinary skill in the art upon examination of the following or can be learned from practice of the disclosure. The objectives and other advantages of the disclosure can be realized and attained by the structure particularly pointed out in the written description and claims hereof as well as the appended drawings.

To achieve these and other advantages and in accordance with the purpose of the disclosure, as embodied and broadly described herein, there is provided a light emitting display apparatus including a first pixel including a first light emitting device and a first pixel driving circuit configured to drive the first light emitting device, a second pixel including a second light emitting device and a second pixel driving circuit configured to drive the second light emitting device, a repair transistor connected between the first light emitting device and the second light emitting device, and a repair control transistor connected to a gate of the repair transistor.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION OF THE EMBODIMENTS

Figure 1:
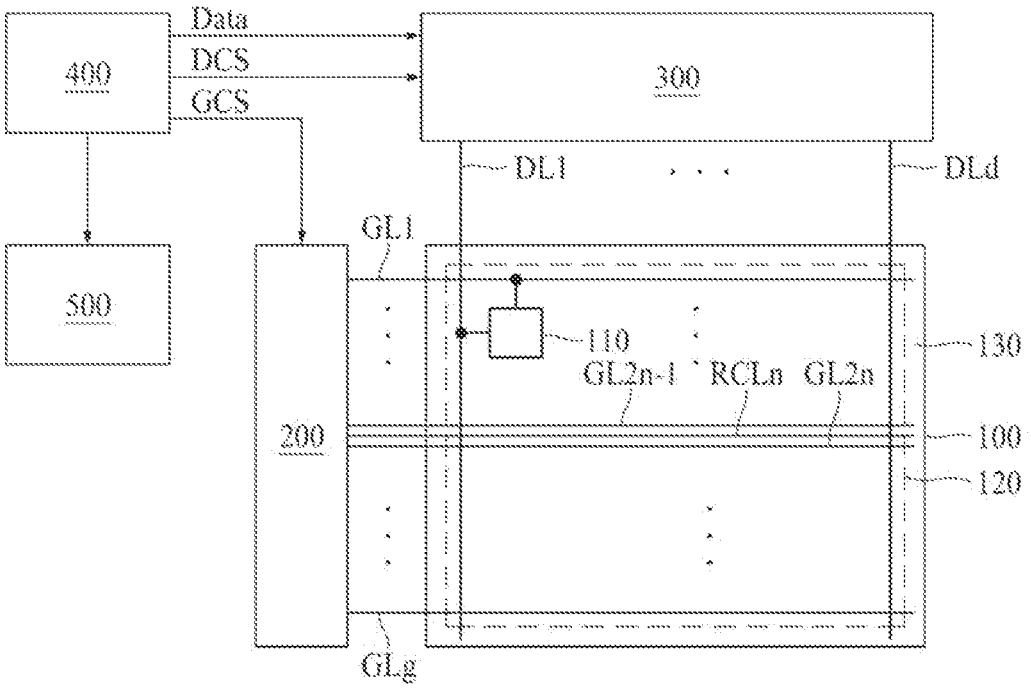
FIG. 1 is an exemplary diagram illustrating a configuration of a light emitting display apparatus according to an embodiment of the present disclosure.

Reference will now be made in detail to the exemplary embodiments of the present disclosure, examples of which are illustrated in the accompanying drawings. Wherever possible, the same reference numbers will be used throughout the drawings to refer to the same or like parts.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted. When "comprise," "have," and "include" described in the present specification are used, another part can be added unless "only" is used. The terms of a singular form can include plural forms unless referred to the contrary.

In construing an element, the element is construed as including an error or tolerance range although there is no explicit description of such an error or tolerance range.

In describing a position relationship, for example, when a position relation between two parts is described as, for example, "on," "over," "under," and "next," one or more other parts can be disposed between the two parts unless a more limiting term, such as "just" or "direct(ly)" is used.

In describing a time relationship, for example, when the temporal order is described as, for example, "after," "subsequent," "next," and "before," a case that is not continuous can be included unless a more limiting term, such as "just," "immediate(ly)," or "direct(ly)" is used.

It will be understood that, although the terms "first," "second," etc. can be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing elements of the present disclosure, the terms "first," "second," "A," "B," "(a)," "(b)," etc. can be used. These terms are intended to identify the corresponding elements from the other elements, and basis, order, or number of the corresponding elements should not be limited by these terms. The expression that an element is "connected," "coupled," or "adhered" to another element or layer the element or layer can not only be directly connected or adhered to another element or layer, but also be indirectly connected or adhered to another element or layer with one or more intervening elements or layers "disposed," or "interposed" between the elements or layers, unless otherwise specified.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure can be partially or overall coupled to or combined with each other, and can be variously inter-operated with each other and driven technically as those skilled in the art can sufficiently understand. The embodiments of the present disclosure can be carried out independently from each other, or can be carried out together in co-dependent relationship.

Hereinafter, embodiments of the present disclosure will be described in detail with reference to the accompanying drawings. All the components of each light emitting display apparatus according to all embodiments of the present disclosure are operatively coupled and configured.

Figure 2:
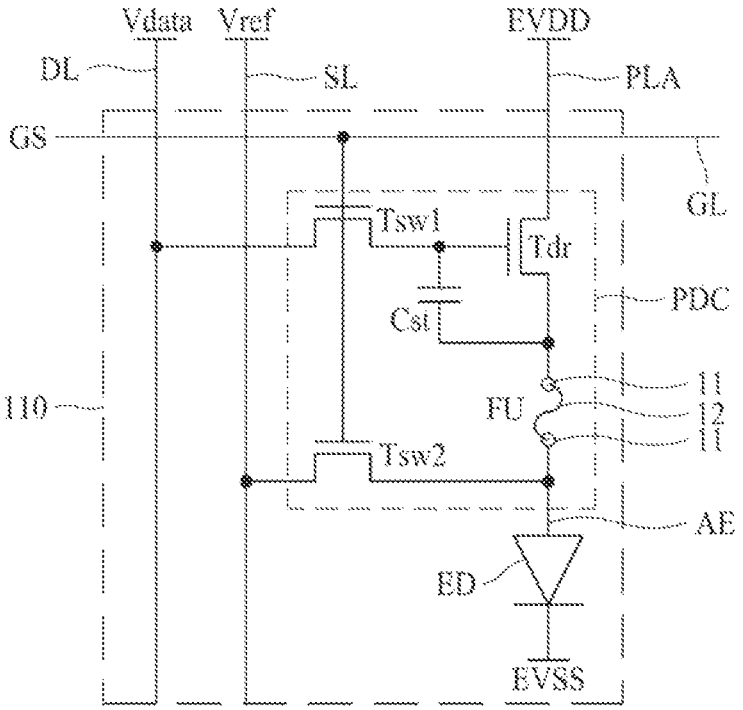
FIG. 2 is an exemplary diagram illustrating a structure of a pixel applied to a light emitting display apparatus according to an embodiment of the present disclosure.
Figure 3:
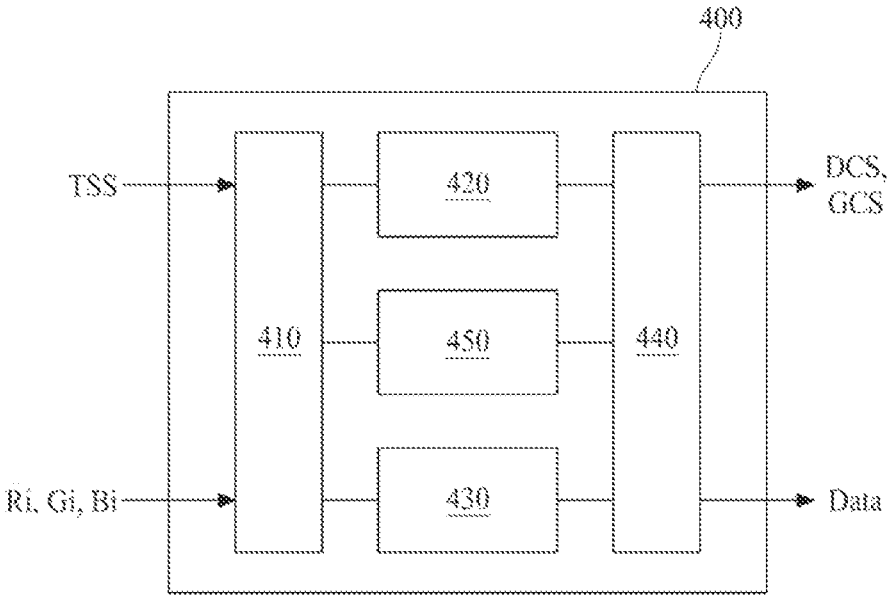
FIG. 3 is an exemplary diagram illustrating a configuration of a controller applied to a light emitting display apparatus according to an embodiment of the present disclosure.
Figure 4:
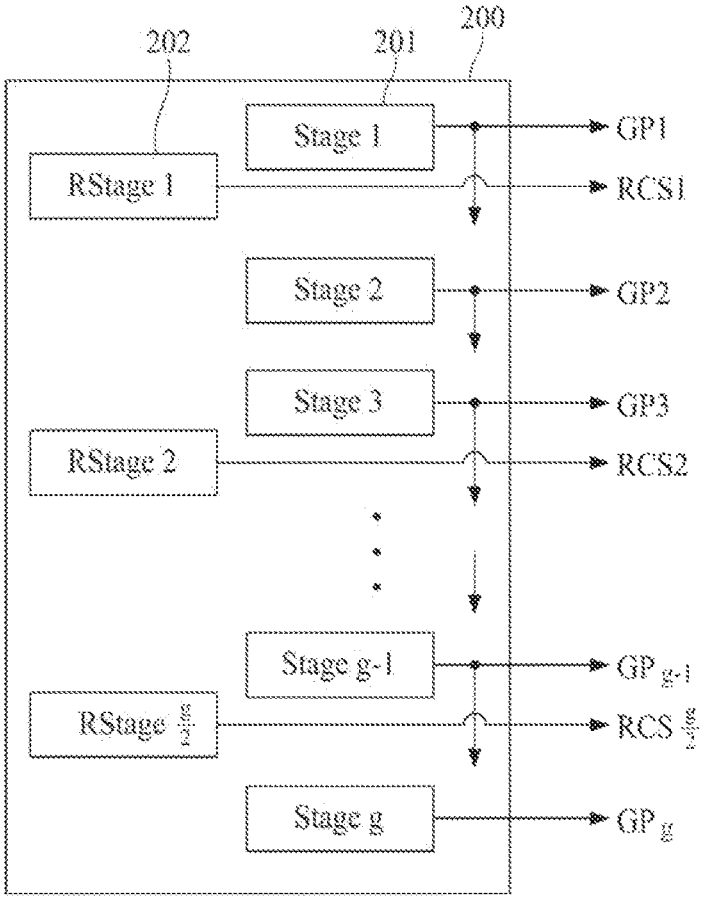
FIG. 4 is an exemplary diagram illustrating a configuration of a gate driver applied to a light emitting display apparatus according to an embodiment of the present disclosure.

FIG. 1 is an exemplary diagram illustrating a configuration of a light emitting display apparatus according to an embodiment of the present disclosure. FIG. 2 is an exemplary diagram illustrating a structure of a pixel applied to the light emitting display apparatus according to an embodiment of the present disclosure. FIG. 3 is an exemplary diagram illustrating a configuration of a controller applied to the light emitting display apparatus according to an embodiment of the present disclosure. FIG. 4 is an exemplary diagram illustrating a configuration of a gate driver applied to the light emitting display apparatus according to an embodiment of the present disclosure. Hereinafter, a basic structure of the light emitting display apparatus according to the present disclosure will be described with reference to FIGS. 1 to 4.

The light emitting display apparatus according to the present disclosure can configure various electronic devices. The electronic devices can include, for example, smartphones, tablet personal computers (PCs), televisions (TVs), and monitors.

The light emitting display apparatus according to the present disclosure, as illustrated in FIG. 1, can include a light emitting display panel 100 which includes a display area 120 for displaying an image and a non-display area 130 provided outside the display area 120, a gate driver 200 which supplies a gate signal to a plurality of gate lines GL1 to GLg provided in the display area 120 of the light emitting display panel 100, a data driver 300 which supplies data voltages to a plurality of data lines DL1 to DLd provided in the light emitting display panel 100, a controller 400 which controls driving of the gate driver 200 and the data driver 300, and a power supply 500 which supplies power to the controller 400, the gate driver 200, the data driver 300, and the light emitting display panel 100.

First, the light emitting display panel 100 can include the display area 120 and the non-display area 130. The gate lines GL1 to GLg, the data lines DL1 to DLd, and the pixels 110 can be provided in the display area 120. Accordingly, the display area 120 can display an image. Here, g and d can each be a natural number such as an integer greater than 1. The non-display area 130 can surround an outer portion of the display area 120.

Each of at least one or more of the pixels 110 included in the light emitting display panel 100, as illustrated in FIG. 2, can include an emission area which includes a pixel driving circuit PDC, including a switching transistor Tsw1, a storage capacitor Cst, a driving transistor Tdr, and a sensing transistor Tsw2, and a light emitting device ED.

A first terminal of the driving transistor Tdr can be connected to a high voltage supply line PLA through which a high voltage EVDD is supplied, and a second terminal of the driving transistor Tdr can be connected to the light emitting device ED.

A first terminal of the switching transistor Tsw1 can be connected to the data line DL, a second terminal of the switching transistor Tsw1 can be connected to a gate of the driving transistor Tdr, and a gate of the switching transistor Tsw1 can be connected to a gate line GL.

A data voltage Vdata can be supplied to a data line DL, and a gate signal GS can be supplied to the gate line GL.

The sensing transistor Tsw2 can be provided for measuring a threshold voltage or mobility of the driving transistor. A first terminal of the sensing transistor Tsw2 can be connected to a second terminal of the driving transistor Tdr and the light emitting device ED, a second terminal of the sensing transistor Tsw2 can be connected to a sensing line SL through which a reference voltage Vref is supplied, and a gate of the sensing transistor Tsw2 can be connected to a sensing control line through which a sensing control signal is supplied.

The sensing line SL can be connected to the data driver 300 and can be connected to the power supply 500 through the data driver 300. For example, the reference voltage Vref supplied from the power supply 500 can be supplied to the pixels through the sensing line SL, and sensing signals transferred from the pixels can be converted into digital signals by the data driver 300.

In this case, the gate line GL can perform a function of the sensing control line. For example, the gate of the sensing transistor Tsw2 and the gate of the switching transistor Tsw1 can be connected to the gate line GL in common. Accordingly, the gate signal GS can be used as the sensing control signal.

However, the sensing control line can be a separate line which is independent of the gate line GL, and the sensing control signal can be supplied through the separately provided sensing control line.

A structure of the pixel 110 applied to the present disclosure is not limited to a structure illustrated in FIG. 2. Accordingly, the structure of the pixel 110 can be changed to various types.

The data driver 300 can be mounted on a chip on film (COF) attached on the light emitting display panel 100, or can be directly equipped in the light emitting display panel 100.

The data driver 300 can supply data voltages Vdata to the data lines DL1 to DLd. The data driver 300 can convert a sensing signal, received through the sensing line SL, into a digital signal and can transfer the digital signal to the controller 400.

The controller 400 can realign input video data transferred from an external system by using a timing synchronization signal transferred from the external system and can generate data control signals DCS which are to be supplied to the data driver 300 and gate control signals GCS which are to be supplied to the gate driver 200.

To this end, as illustrated in FIG. 3, the controller 400 can include a data aligner 430 which realigns input video data to generate image data Data and supplies the image data Data to the data driver 300, a control signal generator 420 which generates the gate control signal GCS and the data control signal DCS by using the timing synchronization signal, an input unit 410 which receives the timing synchronization signal and the input video data transferred from the external system and respectively transfers the timing synchronization signal and the input video data to the data aligner and the control signal generator, and an output unit 440 which supplies the data driver 300 with the image data Data generated by the data aligner 430 and the data control signal DCS generated by the control signal generator and supplies the gate driver 200 with the gate control signals GCS generated by the control signal generator 420.

The controller 400 can include a storage unit 450 for storing various information.

The external system can perform a function of driving the controller 400 and an electronic device. For example, when the electronic device is a TV, the external system can receive various sound information, video information, and letter information over a communication network and can transfer the received video information to the controller 400. In this case, the image information can include input video data.

The power supply 500 can generate various powers and can supply the generated powers to the controller 400, the gate driver 200, the data driver 300, and the light emitting display panel 100.

Finally, the gate driver 200 can be configured as an integrated circuit (IC) and mounted in the non-display area 130. Also, the gate driver 200 can be directly embedded in the non-display area 130 by using a gate in panel (GIP) type. In a case which uses the GIP type, transistors configuring the gate driver 200 can be provided in the non-display area through the same process as transistors included in each of the pixels 110.

The gate driver 200 can supply gate pulses GP1 to GPg or a gate off signal to the gate lines GL1 to GLg. The gate signal GS can include the gate pulse GP and the gate off signal.

For example, the gate driver 200 can supply the gate signals GS to the gate lines in a display period where the pixels 110 displays an image.

To this end, as illustrated in FIG. 4, the gate driver 200 can include a plurality of stages 201.

Each of the stages 201 can be connected to at least one gate line GL. Each of the stages 201 can be driven by a start signal transferred from the controller 400, or can be driven by a start signal transferred from a previous stage or a next stage.

The gate driver 200 can further include a plurality of repair stages 202. However, functions of the repair stages 202 can be performed through the stages 201.

For example, the gate driver 200 can include the stages 201 for outputting repair control signals RCS1 to RCSg/2 and the gate pulses GP1 to GPg.

However, as illustrated in FIG. 4, the gate driver 200 can include the stages 201 which output the gate pulses GP1 to GPg and the repair stages 202 which output the repair control signals RCS1 to RCSg/2.

For example, in the display period where an image is displayed, the gate driver 200 can sequentially output the gate pulses GP1 to GPg to the gate lines GL1 to GLg by using the stages 201, and in a refresh period where a refresh operation is performed, the gate driver 200 can sequentially output the repair control signals RCS1 to RCSg/2 by using the repair stages 202.

A refresh operation and a function of each of the repair stages 202 will be described below.

Figure 5:
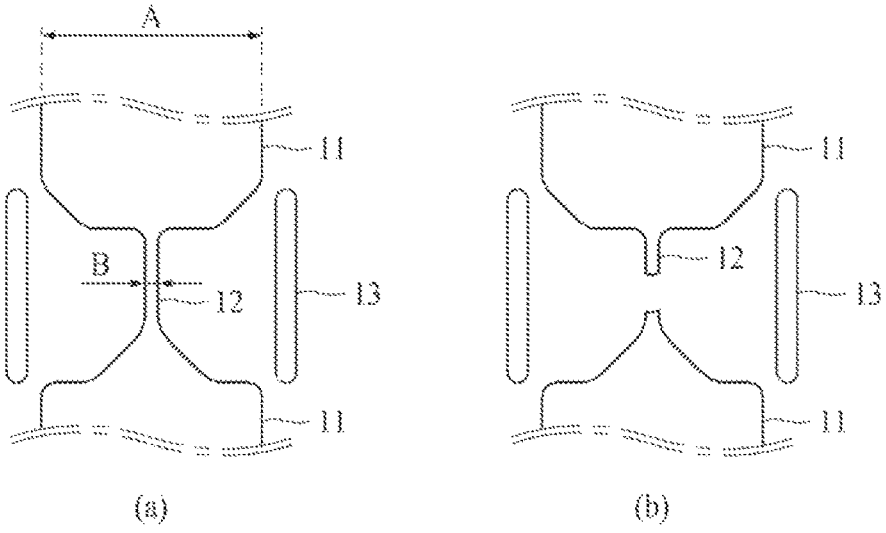
FIG. 5 is an exemplary diagram illustrating a fuse applied to a light emitting display apparatus according to an embodiment of the present disclosure.

FIG. 5 is an exemplary diagram illustrating a fuse applied to the light emitting display apparatus according to the present disclosure.

As described above, the pixel 110 can include the driving transistor Tdr and the light emitting device ED.

In this case, a fuse FU illustrated in FIGS. 2 and 5 can be connected between the driving transistor Tdr and the light emitting device ED.

The fuse FU can be provided between main lines 11 having a first width A and a secondary line 12 which is provided between the main lines 11 and has a second width B which is less than the first width A.

One of the main lines 11 can be connected to a second terminal of the driving transistor Tdr, and the other main line 11 can be connected to an anode electrode AE of the light emitting device ED.

The fuse FU can be used to separate the light emitting device ED, included in a defective pixel, from the driving transistor Tdr included in the defective pixel. For example, when an overvoltage or an overcurrent is supplied to the fuse FU illustrated in (a) of FIG. 5, a resistance of the secondary line 12 having the second width B which is less than the first width A can considerably increase, and thus, the secondary line 12 can be cut as illustrated in (b) of FIG. 5. Accordingly, the driving transistor Tdr and the light emitting device ED included in the defective pixel can be separated from each other.

In this case, in order to prevent fragments of the cut secondary line 12 from being transferred to other elements adjacent to the fuse FU, a shield layer 13 can be formed near the fuse FU. The shield layer 13 can be formed of metal or an inorganic layer.

Figure 6:
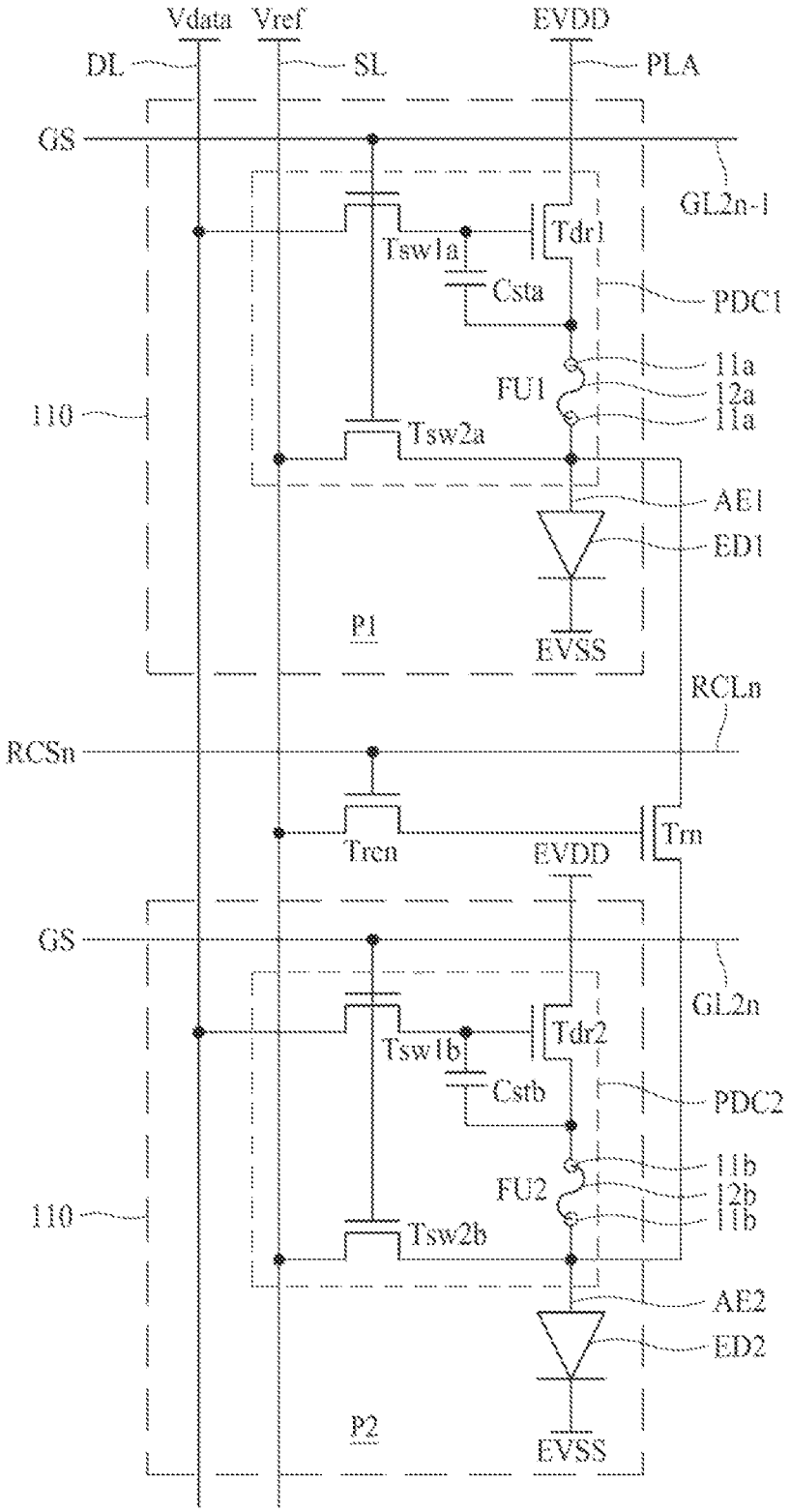
FIG. 6 is an exemplary diagram illustrating a structure of a light emitting display panel applied to a light emitting display apparatus according to an embodiment of the present disclosure.

FIG. 6 is an exemplary diagram illustrating a structure of a light emitting display panel applied to a light emitting display apparatus according to the present disclosure, and particularly, illustrates a first pixel P1 and a second pixel P2 adjacent to each other along a sensing line SL. In the following description, a pixel 110 connected to a 2n-1$^{th}$ gate line GL2*n*-1 can be referred to as a first pixel P1, and a pixel 110 connected to a 2n$^{th}$ gate line GL2*n* can be referred to as a second pixel P2. Here, n can be an odd number which is less than g.

The pixel 110 included in the light emitting display panel 100, as described above with reference to FIG. 2, can include an emission area which includes a pixel driving circuit PDC, including a switching transistor Tsw1, a storage capacitor Cst, a driving transistor Tdr, a sensing transistor Tsw2, and a fuse FU, and a light emitting device ED.

In the following description, a pixel driving circuit PDC included in the first pixel P1 can be referred to as a first pixel driving circuit PDC1, and a pixel driving circuit PDC included in the second pixel P2 can be referred to as a second pixel driving circuit PDC2. A switching transistor Tsw1, a storage capacitor Cst, a driving transistor Tdr, a sensing transistor Tsw2, and a fuse FU included in the first pixel driving circuit PDC1 can be respectively referred to as a first switching transistor Tsw1*a*, a first storage capacitor Csta, a first driving transistor Tdr1, a first sensing transistor Tsw2*a*, and a first fuse FU1. A switching transistor Tsw1, a storage capacitor Cst, a driving transistor Tdr, a sensing transistor Tsw2, and a fuse FU included in the second pixel driving circuit PDC2 can be respectively referred to as a second switching transistor Tsw1*b*, a second storage capacitor Cstb, a second driving transistor Tdr2, a second sensing transistor Tsw2*b*, and a second fuse FU2.

The light emitting display apparatus, as illustrated in FIG. 6, can include the first pixel P1 which includes a first light emitting device ED1 and the first pixel driving circuit PDC1 which drives the first light emitting device ED1, the second pixel P2 which includes a second light emitting device ED2 and the second pixel driving circuit PDC2 which drives the second light emitting device ED2, an n$^{th}$ repair transistor Trn connected between the first light emitting device ED1 and the second light emitting device ED2, and an n$^{th}$ repair control transistor Trcn connected to a gate of the n$^{th}$ repair transistor Trn.

First, each of the first pixel P1 and the second pixel P2 can be one of the pixels 110 described above with reference to FIG. 2. Accordingly, a detailed description thereof is omitted.

A first electrode of the n$^{th}$ repair transistor Trn can be connected to a first anode electrode AE1 of the first light emitting device ED1, a second electrode of the n$^{th}$ repair transistor Trn can be connected to a second anode electrode AE2 of the second light emitting device ED2, and a gate of the n$^{th}$ repair transistor Trn can be connected to the n$^{th}$ repair control transistor Trcn.

For example, the n$^{th}$ repair transistor Trn can be connected to two pixels adjacent to each other, and particularly, can be connected to anode electrodes AE included in two pixels.

The n$^{th}$ repair transistor Trn can be turned on or off by a voltage supplied through the n$^{th}$ repair control transistor Trcn.

In this case, the first fuse FU1 can be connected between the first driving transistor Tdr1 and the first anode electrode AE1 of the first light emitting device ED1, and the second fuse FU2 can be connected between the second driving transistor Tdr2 and the second anode electrode AE2 of the second light emitting device ED2.

Each of the first fuse HA and the second fuse FU2 can be the fuse FU described above with reference to FIG. 5.

Therefore, one of first main lines 11*a* configuring the first fuse HA can be connected to the first driving transistor Tdr1, and the other first main line 11*a* can be connected to the first anode electrode AE1. One of second main lines 11*b* configuring the second fuse FU2 can be connected to the second driving transistor Tdr2, and the other second main line 11*b* can be connected to the second anode electrode AE2.

Finally, a gate of the n$^{th}$ repair control transistor Trcn can be connected to an n$^{th}$ repair control line RCLn, a first electrode of the n$^{th}$ repair control transistor Trcn can be connected to a gate of the n$^{th}$ repair transistor Trn, and a second electrode of the n$^{th}$ repair control transistor Trcn can be connected to a sensing line SL connected to the first pixel P1 and the second pixel P2. In FIG. 6, the n$^{th}$ repair control line RCLn provided between a 2n-1$^{th}$ gate line GL2*n*-1 and a 2n$^{th}$ gate line GL2*n* is illustrated.

In the following description, in a case where descriptions of all repair control lines including an n$^{th}$ repair control line RCLn are needed, a repair control line can be used, and reference numeral RCL refers to a repair control line. Also, in a case where descriptions of all repair control signals including an n$^{th}$ repair control signal RCSn are needed, a repair control signal can be used, and reference numeral RCS refers to a repair control signal.

An n$^{th}$ repair control line RCLn can be arranged in parallel with a 2n-1$^{th}$ gate line GL2*n*-1 and a 2n$^{th}$ gate line GL2*n*.

The n$^{th}$ repair control line RCLn can be connected to one of the stages 201 included in the gate driver 200. The stage 201 can output a gate signal GS to a gate line GL in the display period and can output an n$^{th}$ repair control signal RCSn to the n$^{th}$ repair control line RCLn in the refresh period. The n$^{th}$ repair control signal RCSn can be a signal for turning on the n$^{th}$ repair control transistor Trcn. A signal for turning off the n$^{th}$ repair control transistor Trcn can be referred to as a repair off signal. Hereinafter, a generic name for the n$^{th}$ repair control signal RCSn and the n$^{th}$ repair off signal can be an n$^{th}$ repair signal RSn. However, in a case where descriptions of all repair control signals including an n$^{th}$ repair control signal RCSn are needed, a repair control signal can be used, and reference numeral RCS refers to a repair control signal. Also, in a case where descriptions of all repair signals including an n$^{th}$ repair signal RSn are needed, a repair signal can be used, and reference numeral RS refers to a repair signal.

For example, in the gate driver 200 including only the stages 201, the stages 201 can output the gate pulses GP1 to GPg and the repair control signals RCS1 to RCSg/2, and to this end, the gate lines GL1 to GLg and the repair control lines RCL can be connected to the stages 201.

In this case, the number of repair control lines RCL can be ½ of the gate lines GL1 to GLg, and thus, the repair control lines RCL can be connected to only odd-numbered stages or even-numbered stages.

However, as illustrated in FIG. 4, the repair stages 202 for supplying the repair control signals RCS1 to RCSg/2 to the repair control lines RCL in a repair period and the stages 201 can be independently included in the gate driver 200.

The repair stages 202 can sequentially generate the repair control signals RCS1 to RCSg/2 in the repair period and can supply the repair control signals RCS1 to RCSg/2 to the repair control lines RCL. The repair stages 202 can supply all repair control lines RCL with the repair signals RS for turning on all repair control transistors Trc in the display period.

The repair period can denote a period where the pixels 110 display an image.

The refresh period can be a period until the display period starts from after the light emitting display apparatus is turned on, or can be a period until the light emitting display apparatus is turned off from after the display period ends. The light emitting display apparatus being turned on can denote that the light emitting display apparatus performs a prepare operation for displaying an image, and the light emitting display apparatus being turned off can denote that only a standby power is simply supplied to the light emitting display apparatus.

FIGS. 7A to 7D are exemplary diagrams for describing a feature of a repair transistor applied to a light emitting display apparatus according to the present disclosure.

A threshold voltage of the repair transistor Tr can vary based on a level of a voltage applied to the gate of the repair transistor Tr.

For example, in a case where the threshold voltage of the repair transistor Tr is A, when a first voltage is supplied to the gate of the repair transistor Tr, the repair transistor Tr may not be turned on.

In this case, when a second voltage which is lower than the first voltage is continuously supplied to the gate of the repair transistor Tr during a predetermined period, the threshold voltage of the repair transistor Tr is shifted from A to B. Here, the predetermined period can be variously set based on a material included in the repair transistor Tr or a size of the repair transistor Tr.

When the first voltage is supplied to a gate of the repair transistor Tr where the threshold voltage thereof has been shifted from A to B, the repair transistor Tr can be turned on.

The repair transistor Tr having a feature described above can be a floating gate MOS (FGMOS) used in flash memory, or can be one of eNVM and an embedded non-volatile memory.

Hereinafter, an operation principle of a FGMOS usable as the repair transistor Tr will be simply described with reference to FIGS. 7A to 7D.

Figure 7A:
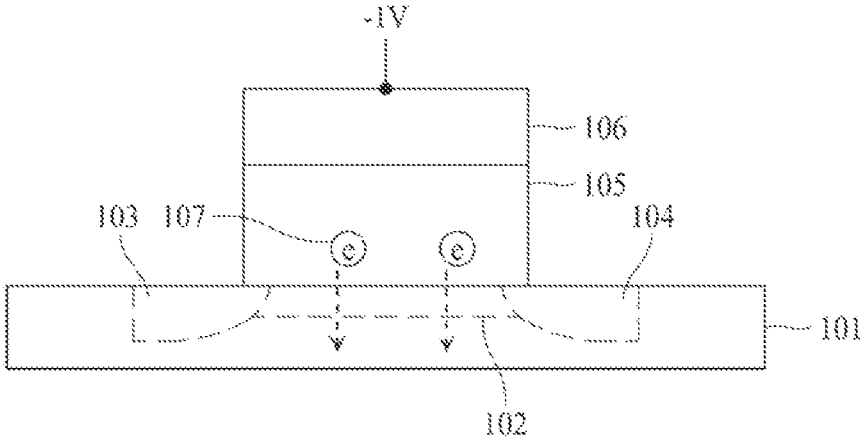
FIGS. 7A to 7D are exemplary diagrams for describing a feature of a repair transistor applied to a light emitting display apparatus according to an embodiment of the present disclosure.

The FGMOS, as illustrated in FIG. 7A, can include a substrate 101 including a semiconductor region 102, a first electrode 103, and a second electrode 104, a gate 106, and an insulation layer 105 provided between the gate 106 and an semiconductor region 102.

The insulation layer 105 can be formed by stacking silicon oxide ($SiO_2$), silicon nitride ($Si_3N_4$), and $SiO_2$, or can be formed by stacking various kinds of nitrides and oxides.

Figure 7B:
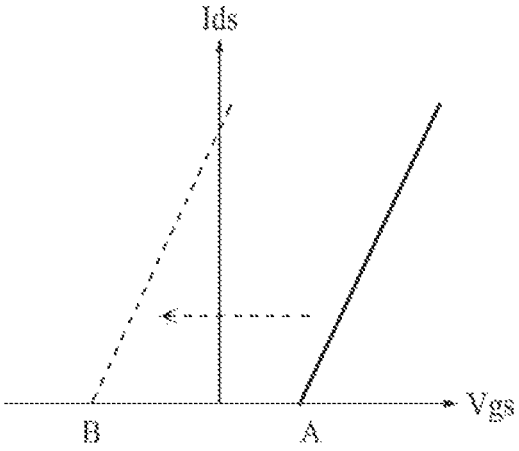

First, as illustrated in FIGS. 7A and 7B, when the FGMOS has a threshold voltage A having a positive (+) value, a voltage having a negative (−) value which is lower than that of the threshold voltage A of the FGMOS can be continuously supplied to the gate 106 of the FGMOS during, for example, a period where −1 V is previously set.

In this case, electrons 107 can be discharged in a direction from the insulation layer 105 to a substrate.

When the electrons 107 are discharged from the insulation layer 105, a channel can be easily formed in the semiconductor region 102. Accordingly, the FGMOS can have a new threshold voltage B which is less than a previous threshold voltage A.

Therefore, when a voltage which is lower than the previous threshold voltage A and higher than the new threshold voltage B is supplied, the FGMOS can be turned on.

For example, when a voltage which is higher than the previous threshold voltage A is applied to the gate, the FGMOS can be turned on, and when a voltage which is lower than the previous threshold voltage A is applied to the gate, the FGMOS may not be turned on.

On the other hand, when a voltage which is lower than the previous threshold voltage A and higher than the new threshold voltage B is supplied, the FGMOS having the new threshold voltage B can be turned on.

For example, the FGMOS having the new threshold voltage B can be turned on by a voltage which is lower than the FGMOS having the previous threshold voltage A.

The new threshold voltage B can be continuously maintained.

Figure 7C:
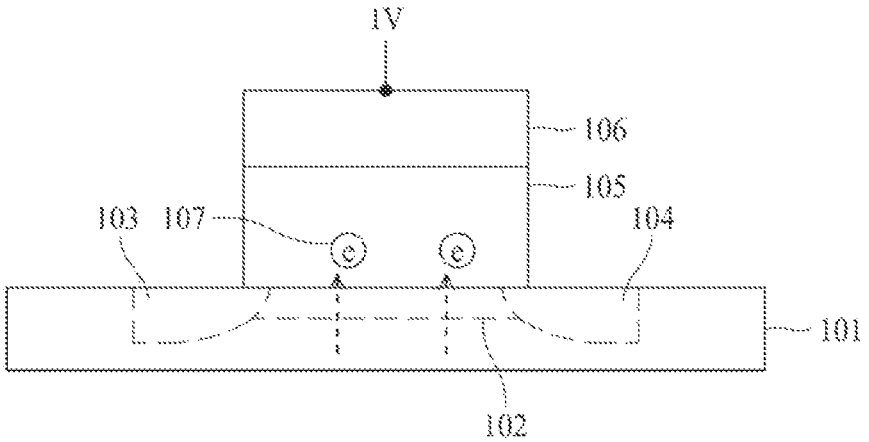
Figure 7D:
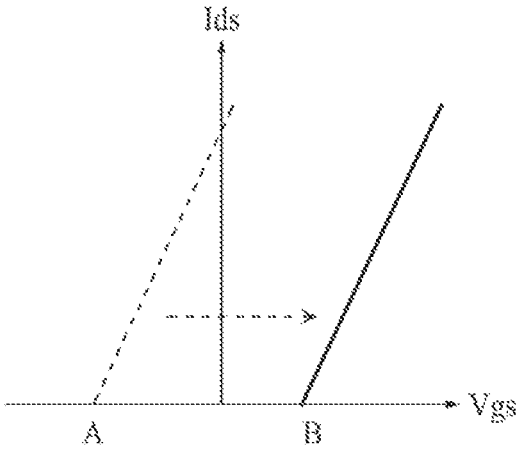

Second, as illustrated in FIGS. 7C and 7D, when the FGMOS has the threshold voltage A having a negative (−) value, a voltage having a positive (+) value which is higher than that of the threshold voltage A of the FGMOS can be continuously supplied to the gate 106 of the FGMOS during, for example, a period where 1 V is previously set.

In this case, the electrons 107 can be trapped in the insulation layer 105.

When the electrons 107 are trapped in the insulation layer 105, a channel can be difficult to be formed in the semiconductor region 102. Accordingly, the FGMOS can have the new threshold voltage B which is higher than the previous threshold voltage A.

Therefore, when a voltage which is higher than the previous threshold voltage A and lower than the new threshold voltage B is supplied, the FGMOS can be turned on.

For example, when a voltage which is lower than the previous threshold voltage A is applied to the gate of the FGMOS, the FGMOS having the previous threshold voltage A can be turned on, and when a voltage which is higher than the previous threshold voltage A is applied to the gate of the FGMOS, the FGMOS may not be turned on.

On the other hand, when a voltage which is higher than the previous threshold voltage A and lower than the new threshold voltage B is supplied, the FGMOS having the new threshold voltage B can be turned on.

For example, the FGMOS having the new threshold voltage B can be turned on by a voltage which is higher than the FGMOS having the previous threshold voltage A.

The new threshold voltage B can be continuously maintained.

Hereinafter, a light emitting display apparatus where a FGMOS having features described above with reference to FIGS. 7A and 7B is used as a repair transistor Tr will be described as an example of the present disclosure.

Figure 8:
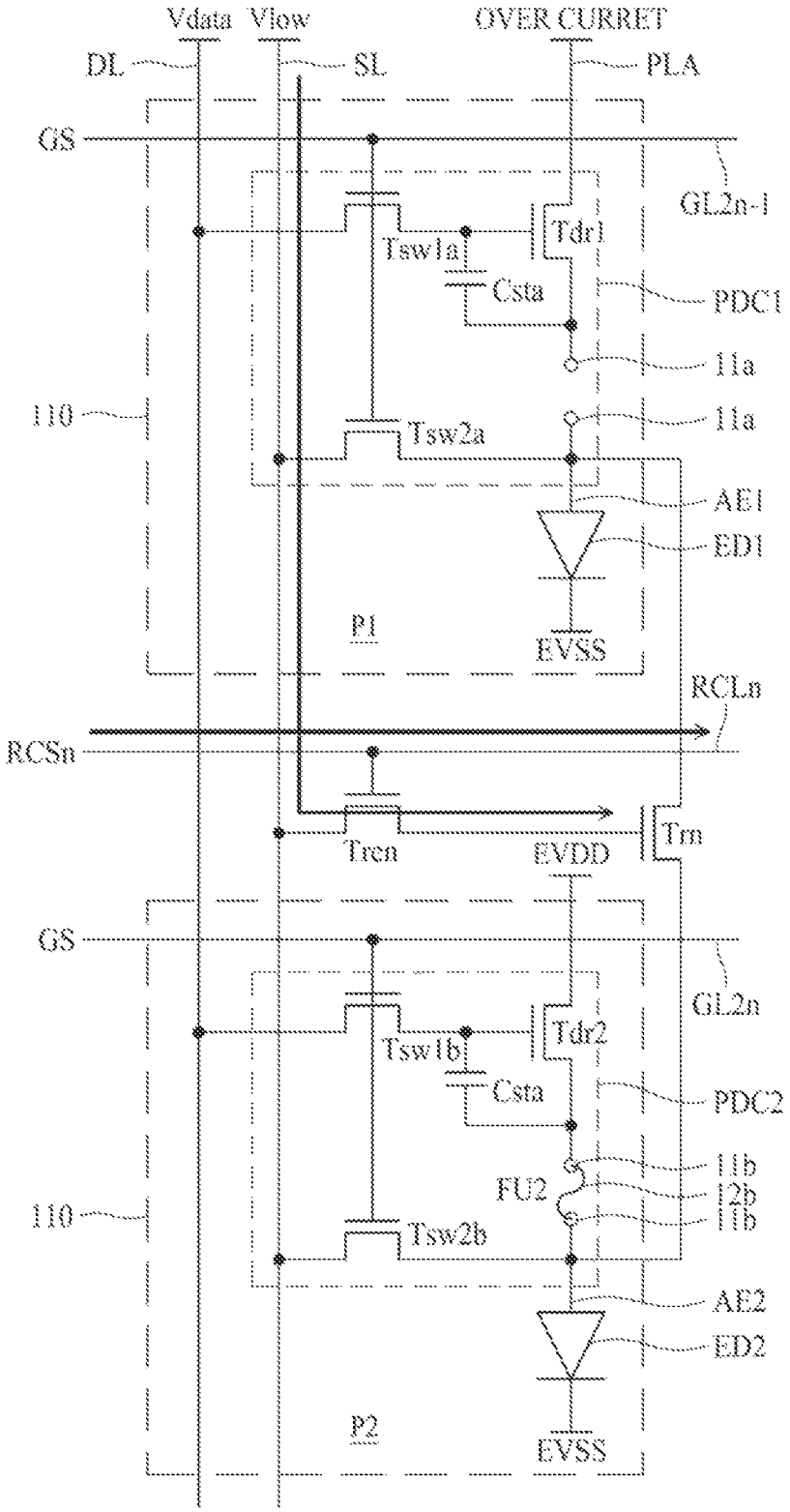
FIG. 8 is an exemplary diagram illustrating a method of varying a threshold voltage of a repair transistor connected to a normal pixel and a defective pixel in a light emitting display apparatus according to an embodiment of the present disclosure.
Figure 9:
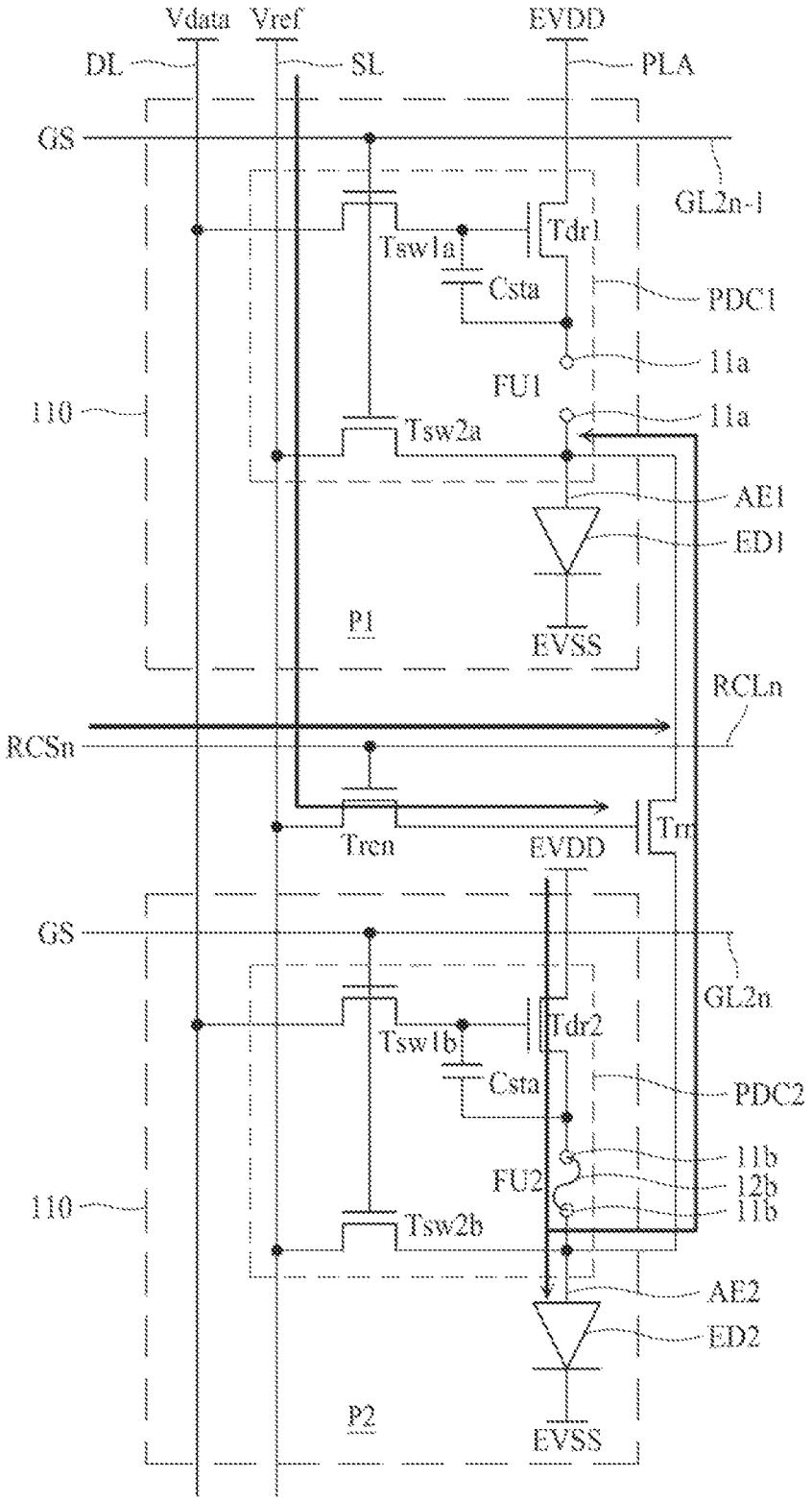
FIG. 9 is an exemplar diagram illustrating a method of driving the light emitting display apparatus illustrated in FIG. 8 in a display period.

FIG. 8 is an exemplary diagram illustrating a method of varying a threshold voltage of a repair transistor connected to a normal pixel and a defective pixel in a light emitting display apparatus according to the present disclosure, and FIG. 9 is an exemplar diagram illustrating a method of driving the light emitting display apparatus illustrated in FIG. 8 in a display period.

In the following description, a light emitting display panel where the first pixel P1 illustrated in FIG. 6 is a defective pixel and the second pixel P2 illustrated in FIG. 6 is a normal pixel will be described as an example of the present disclosure.

A defective pixel can be detected in a process of manufacturing a light emitting display apparatus.

First, an overcurrent can be supplied to a first terminal of a first driving transistor Tdr1 included in the first pixel P1. For example, in a state where the first driving transistor Tdr1 is turned on, an overcurrent can be supplied to the first terminal of the first driving transistor Tdr1. In this case, an overcurrent can be supplied to the first terminal of the first driving transistor Tdr1 through the power supply 500, or an overcurrent can be supplied to the first terminal of the first driving transistor Tdr1 through a repair power supply included in a repair device.

Therefore, an overcurrent can be supplied to a first fuse FU1 through the first driving transistor Tdr1.

A resistance of a first secondary line 12*a* of the first fuse FU1 can considerably increase due to an overcurrent, and thus, high heat can occur in the first secondary line 12*a* and the first secondary line 12*a* can be cut as illustrated in FIG. 5 (*b*).

For example, an overcurrent can denote a current which causes the first secondary line 12*a* to be cut. In FIG. 8, the first pixel P1 where the first secondary line 12*a* is cut through the process is illustrated in FIG. 8.

In a state where the first secondary line 12*a* is cut, an $n^{th}$ repair control signal RCSn can be supplied to an $n^{th}$ repair control line RCLn, and thus, an $n^{th}$ repair control transistor Trcn can be turned on.

The $n^{th}$ repair control signal RCSn can be supplied from the gate driver 200, or can be supplied from a repair device connected to the $n^{th}$ repair control line RCLn.

Subsequently, a sensing line SL can be supplied with a second voltage Vlow (for example, −1 V) which is lower than a first voltage Vref (for example, 0 V) supplied through the sensing line SL in the display period.

In this case, the second voltage Vlow can be supplied to the sensing line SL through the repair power supply or the power supply 500.

In the process, because the $n^{th}$ repair control transistor Trcn has been turned on, the second voltage Vlow can be supplied to a gate of an $n^{th}$ repair transistor Trn through the $n^{th}$ repair control transistor Trcn.

For example, in a case where a threshold voltage of a repair transistor Tr provided between normal pixels is A, when the first voltage Vref is supplied to a gate of the repair transistor Tr provided between the normal pixels in the display period, the repair transistor Tr may not be turned on.

In this case, the second voltage Vlow which is lower than the first voltage can be supplied through the sensing line SL to the $n^{th}$ repair transistor Trn connected between the first pixel P and a second pixel P2.

Subsequently, as described above with reference to FIGS. 7A and 7B, when the second voltage Vlow which is lower than the first voltage Vref is continuously supplied to a gate of the $n^{th}$ repair transistor Trn, a threshold voltage of the $n^{th}$ repair transistor Trn can be shifted to B which is less than A.

After the processes described above are performed, the other manufacturing process performed on the light emitting display apparatus can be performed, and thus, the light emitting display apparatus can be finished.

In this case, the threshold voltage of the $n^{th}$ repair transistor Trn can be maintained as B.

When the light emitting display apparatus is used by a user, the first voltage Vref can be supplied to a gate of the $n^{th}$ repair transistor Trn where the threshold voltage thereof has been shifted from A to B, and thus, the $n^{th}$ repair transistor Trn can be turned on.

For example, in the display period of the light emitting display apparatus, the $n^{th}$ repair control signal RCSn can be supplied to the $n^{th}$ repair control line RCLn, and thus, the $n^{th}$ repair control transistor Trcn can be turned on.

In this case, the first voltage Vref can be supplied to the sensing line SL by the power supply 500.

Because the $n^{th}$ repair control transistor Trcn is turned on in the display period, the first voltage Vref supplied through the sensing line SL can be supplied to the gate of the $n^{th}$ repair transistor Trn through the $n^{th}$ repair control transistor Trcn.

Because the threshold voltage of the $n^{th}$ repair transistor Trn is shifted from A to B, the $n^{th}$ repair transistor Trn can be turned on by the first voltage Vref.

Finally, as illustrated in FIG. 9, a portion of a current supplied to a second light emitting device ED2 through a second driving transistor Tdr2 in the display period can be supplied to a first light emitting device ED1 through the $n^{th}$ repair transistor Trn.

Accordingly, the first light emitting device ED1 and the second light emitting device ED2 can normally emit light.

For example, light can be normally emitted from the first pixel P1 which is a defective pixel, in addition to the second pixel P2 which is a normal pixel.

In this case, because a portion of a current supplied to the second light emitting device ED2 is supplied to the first light emitting device ED1, the second light emitting device ED2 may not emit light having luminance corresponding to the second light emitting device ED2. For example, because the light emitting device ED emits light having luminance corresponding to the amount of current, when the amount of current is reduced, light where luminance is reduced can be emitted.

In order to prevent such a problem, the controller 400 can correct input image data corresponding to the second light emitting device ED2. To this end, a repair process described above with reference to FIG. 8 can be performed, and then, position information about the second pixel P2 can be stored in the storage unit 450.

Therefore, when input image data corresponding to the position information about the second pixel P2 is received, the controller 400 can generate correction image data for enabling the output of luminance which is greater than luminance based on the input image data.

A current corresponding to the correction image data can be distributed to the second light emitting device ED2 and the first light emitting device ED1 through the second driving transistor Tdr2, and thus, the second light emitting device ED2 can emit light having luminance corresponding to the input image data.

In this case, the correction image data can be calculated based on all luminance of the first pixel P1 and the second pixel P2.

Figure 10:
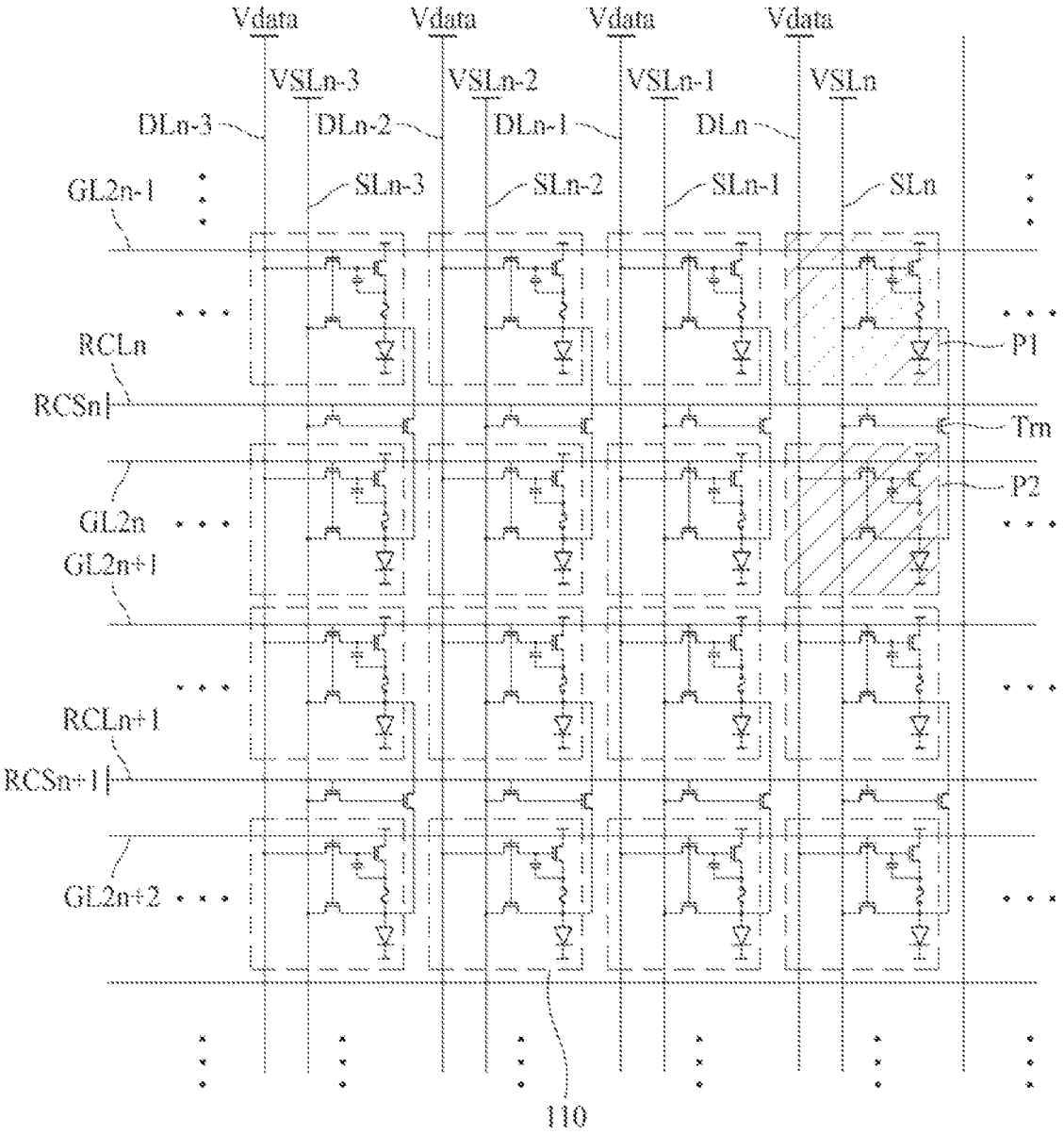
FIGS. 10 and 11 are exemplary diagrams for describing a refresh period applied to a light emitting display apparatus according to an embodiment of the present disclosure.
Figure 11:
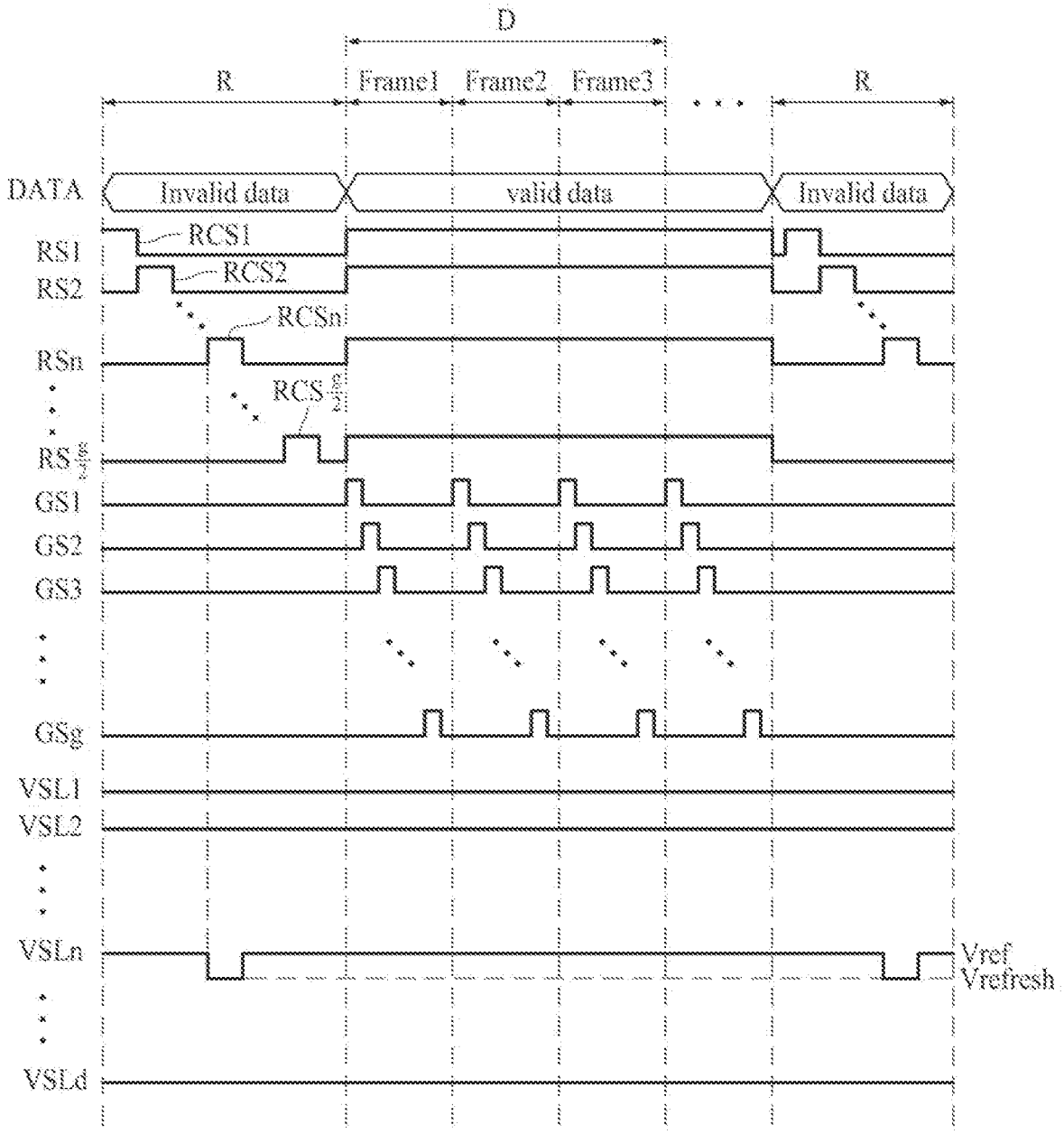

FIGS. 10 and 11 are exemplary diagrams for describing a refresh period applied to a light emitting display apparatus according to the present disclosure. In the following description, descriptions which are the same as or similar to the descriptions of FIGS. 1 to 8 can be omitted or will be briefly given.

In performing a process of manufacturing the light emitting display apparatus, a repair process described above with reference to FIG. 8 can be performed.

For example, in a case where a threshold voltage of an $n^{th}$ repair transistor Trn measured in a manufacturing process on a light emitting display panel is A, when a first voltage Vref is supplied to a gate of an $n^{th}$ repair transistor Trn, the $n^{th}$ repair transistor Trn may not be turned on.

In this case, when a second voltage Vlow which is lower than the first voltage Vref is supplied to the gate of the $n^{th}$ repair transistor Trn during a predetermined period, a threshold voltage of the $n^{th}$ repair transistor Trn can be shifted to B which is less than A.

In a case where a light emitting display apparatus is finished in manufacturing and is used by a user, when the first voltage Vref is supplied to the gate of the $n^{th}$ repair transistor Trn having a threshold voltage shifted from A to B in the display period, the $n^{th}$ repair transistor Trn can be turned on.

For example, in performing a manufacturing process on the light emitting display panel, the $n^{th}$ repair transistor Trn where a characteristic has been changed to have the threshold voltage B can be turned on in the display period where an image is displayed.

Therefore, as illustrated in FIG. 9, a portion of a current flowing through a second driving transistor Tdr2 of a second pixel P2 can flow to a second light emitting device ED2, and the other portion can flow to a first light emitting device ED1.

Accordingly, in addition to the pixel P2 which is a normal pixel, a first pixel P1 which is a defective pixel can display an image.

However, when the light emitting display apparatus is continuously used, the threshold voltage of the $n^{th}$ repair transistor Trn can be shifted from B to A again, or can be shifted to have a value similar to A.

In this case, the $n^{th}$ repair transistor Trn may not be turned on by a reference voltage Vref (i.e., the first voltage) supplied to a sensing line SL in the display period.

When the $n^{th}$ repair transistor Trn is not turned on, a current may not be supplied to a first pixel P1, and thus, the first pixel P1 which is a defective pixel may not display an image.

In order to address such a problem, a refresh operation can be performed on the $n^{th}$ repair transistor Trn before the display period starts after the light emitting display apparatus is turned, or before the light emitting display apparatus is turned off after the display period ends.

To this end, position information about the $n^{th}$ repair transistor Trn where the threshold voltage has been shifted from A to B in performing a manufacturing process on the light emitting display apparatus can be stored in the controller 400.

In this case, all repair control transistors Trc including an $n^{th}$ repair control transistor Trcn can be connected to the repair stages 202 or the stages 201 included in the gate driver 200.

First, when a refresh period R for refreshing a threshold voltage of at least one repair transistor Tr arrives, the controller 400 can transfer a control signal, which allows all repair control transistors Trc to be sequentially turned on, to the gate driver 200.

A plurality of repair control transistors Trc can be connected to at least one repair control line RCL. Accordingly, the plurality of repair control transistors Trc connected to the at least one repair control line RCL can be simultaneously turned on by one repair control signal RCS.

To this end, the gate driver 200 can sequentially output repair control signals RCS1 to RCSg/2 to the repair control lines RCL and can output the $n^{th}$ repair control signal RCSn to an $n^{th}$ repair control line RCLn.

When the $n^{th}$ repair control signal RCSn is supplied to the $n^{th}$ repair control transistor Trcn through the $n^{th}$ repair control line RCLn, the $n^{th}$ repair control transistor Trcn can be turned on.

In this case, a refresh period R can be variously set. For example, after the refresh period R ends, a display period D where an image is displayed can start in the first pixel P1 and the second pixel P2, and after the display period D ends, the refresh period R can start.

For example, as illustrated in FIG. 11, when the light emitting display apparatus is turned on and driven, the refresh period R can start, and when the refresh period R ends, the display period D can start.

Moreover, after the display period D of the light emitting display apparatus ends, the refresh period R can start, and when the refresh period R ends, the light emitting display apparatus can be turned off.

Moreover, the refresh period R can be provided before and after the display period D. For example, a refresh operation can be performed before and after the display period D.

Subsequently, at a timing at which the $n^{th}$ repair control transistor Trcn is turned on, a refresh voltage Vrefresh which is lower than a first voltage Vref can be supplied through an $n^{th}$ sensing line SLn.

For example, the first voltage Vref can be supplied to sensing lines SL except the $n^{th}$ sensing line SLn, and the refresh voltage Vrefresh can be supplied to only the $n^{th}$ sensing line SLn. However, when another defective pixel other than the first pixel P1 is provided in the light emitting display panel, the refresh voltage can be supplied to a sensing line connected to the other defective pixel.

Hereinafter, as illustrated in FIG. 10, a light emitting display panel where only a threshold voltage of an $n^{th}$ repair transistor Trn connected between the $n^{th}$ sensing line SLn and the $n^{th}$ repair control line RCLn is shifted will be described as an example of the present disclosure. However, a refresh operation performed on the $n^{th}$ repair transistor Trn can be identically applied to another repair transistor Trn included in the light emitting display panel. For example, when another repair transistor where a threshold voltage has been shifted from A to B in performing a manufacturing process on the light emitting display apparatus is provided in the light emitting display panel, a refresh operation performed on the $n^{th}$ repair transistor Trn can be identically performed on the other repair transistor.

As described above, the controller 400 can control the power supply 500 so that the first voltage Vref is supplied to sensing lines EL except the $n^{th}$ sensing line SLn and the refresh voltage Vrefresh is supplied to only the $n^{th}$ sensing line SLn. For example, the controller 400 can control the power supply 500 so that the refresh voltage Vrefresh which is lower than the first voltage Vref is supplied to the $n^{th}$ sensing line SLn connected to the $n^{th}$ repair control transistor Trcn.

For example, based on control by the controller 400, the power supply 500 can supply the first voltage Vref to the sensing lines SL except the $n^{th}$ sensing line SLn and can supply the refresh voltage Vrefresh to only the $n^{th}$ sensing line SLn.

In another method, the controller 400 can turn on only a switch connected to the $n^{th}$ sensing line SLn among switches connected between sensing lines and a refresh supply unit which is included in the power supply 500 and outputs the refresh voltage Vrefresh. Accordingly, the refresh voltage Vrefresh can be supplied to the $n^{th}$ sensing line SLn by the refresh supply unit.

In addition, through various methods, the refresh voltage Vrefresh can be supplied to the $n^{th}$ sensing line SLn.

Finally, through processes described above, when the $n^{th}$ repair control transistor Trcn is turned on, the refresh voltage Vrefresh can be supplied to a gate of the $n^{th}$ repair transistor Trn through the $n^{th}$ repair control transistor Trcn.

The refresh voltage Vrefresh can be a voltage which is the same as a voltage B used for shifting a threshold voltage, or can be another voltage.

When the refresh voltage Vrefresh is supplied to a gate of the $n^{th}$ repair control transistor Trcn, a threshold voltage of the $n^{th}$ repair transistor Trn can move toward a threshold voltage B illustrated in FIG. 7B again.

Accordingly, the $n^{th}$ repair transistor Trn can be continuously turned on by the first voltage Vref supplied in the display period.

Therefore, the first pixel P1 which is a defective pixel can continuously emit light.

According to the present disclosure, a defective pixel can be normally driven even without physical repair and welding. Accordingly, the manufacturing cost of a light emitting display apparatus can be reduced, and a manufacturing process can be simplified.

Particularly, according to the present disclosure, a defective pixel occurring in a light emitting display panel using a silicon substrate can be normally driven also.

The above-described feature, structure, and effect of the present disclosure are included in at least one embodiment of the present disclosure, but are not limited to only one embodiment. Furthermore, the feature, structure, and effect described in at least one embodiment of the present disclosure can be implemented through combination or modification of other embodiments by those skilled in the art. Therefore, content associated with the combination and modification should be construed as being within the scope of the present disclosure.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A light emitting display apparatus comprising:

a first pixel including a first light emitting device and a first pixel driving circuit configured to drive the first light emitting device;

a second pixel including a second light emitting device and a second pixel driving circuit configured to drive the second light emitting device;

a repair transistor connected between the first light emitting device and the second light emitting device; and a repair control transistor connected to a gate of the repair transistor, wherein the first pixel driving circuit is connected to a first gate line, the second pixel driving circuit is connected to a second gate line, a gate of the repair control transistor is connected to a repair control line through which a repair control signal is provided, and the repair control signal is different from a first gate signal provided through the first gate line and a second gate signal provided through the second gate line.

2. The light emitting display apparatus of claim 1, wherein a first electrode of the repair transistor is connected to a first anode electrode of the first light emitting device, and a second electrode of the repair transistor is connected to a second anode electrode of the second light emitting device.

3. The light emitting display apparatus of claim 1, wherein the gate of the repair control transistor is connected to the repair control line, a first electrode of the repair control transistor is connected to the gate of the repair transistor, and a second electrode of the repair control transistor is connected to a sensing line connected between the first pixel driving circuit and the second pixel driving circuit.

4. The light emitting display apparatus of claim 1, wherein a first fuse is connected between the first light emitting device and a first driving transistor included in the first pixel driving circuit, and a second fuse is connected between the second light emitting device and a second driving transistor included in the second pixel driving circuit.

5. The light emitting display apparatus of claim 4, wherein the first fuse comprises first main lines having a first width and a first secondary line which is provided between the first main lines and has a second width being less than the first width, and the second fuse comprises second main lines having a third width and a second secondary line which is provided between the second main lines and has a fourth width being less than the third width.

6. The light emitting display apparatus of claim 5, wherein one of the first main lines is connected to the first driving transistor, and another one of the first main lines is connected to a first anode electrode of the first light emitting device, and one of the second main lines is connected to the second driving transistor, and another one of the second main lines is connected to a second anode electrode of the second light emitting device.

7. The light emitting display apparatus of claim 1, wherein a threshold voltage of the repair transistor varies based on a level of a voltage applied to a gate of the repair transistor.

8. The light emitting display apparatus of claim 1, wherein, in a case where a threshold voltage of the repair transistor is a first threshold voltage, when a first voltage is supplied to a gate of the repair transistor, the repair transistor is not turned on, when a second voltage being lower than the first voltage is supplied to the gate of the repair transistor during a predetermined period, the threshold voltage of the repair transistor is shifted to a second threshold voltage being less than the first threshold voltage, and when the first voltage is supplied to the gate of the repair transistor where the threshold voltage has been shifted from the first threshold voltage to the second threshold voltage, the repair transistor is turned on.

9. The light emitting display apparatus of claim 8, wherein position information regarding the repair transistor, where the threshold voltage has been shifted from the first threshold voltage to the second threshold voltage, is stored in a controller, the first light emitting device and the first pixel driving circuit are disconnected, a gate of the repair control transistor is connected to a gate driver, when a refresh period for refreshing the threshold voltage of the repair transistor arrives, the controller transfers a control signal for allowing the repair control transistor to be turned on, to the gate driver, and the controller controls a power supply so that a refresh voltage being lower than the first voltage is supplied to a sensing line connected to the repair control transistor.

10. The light emitting display apparatus of claim 9, wherein, when the repair control transistor is turned on, the refresh voltage is supplied to a gate of the repair transistor through the repair control transistor.

11. The light emitting display apparatus of claim 9, wherein, after the refresh period ends, a display period starts where the first pixel and the second pixel display an image, or after the display period ends, the refresh period starts.

12. The light emitting display apparatus of claim 9, wherein the controller corrects input image data corresponding to the second light emitting device.

13. The light emitting display apparatus of claim 1, wherein the repair control line connected to the gate of the repair control transistor is arranged in parallel with gate lines connected to the first pixel and the second pixel.

14. A light emitting display apparatus comprising:

a first pixel including a first light emitting device and a first pixel driving circuit configured to drive the first light emitting device;

a second pixel including a second light emitting device and a second pixel driving circuit configured to drive the second light emitting device;

a repair transistor connected between the first light emitting device and the second light emitting device; and a repair control transistor connected to a gate of the repair transistor, wherein a threshold voltage of the repair transistor varies based on a level of a voltage applied to a gate of the repair transistor.

* * * * *